United States Patent [19]

Phalin et al.

[11] 4,412,440

[45] Nov. 1, 1983

[54] PROCESS FOR MAKING CONTAINER

[75] Inventors: Thomas L. Phalin, Cary; James J. Ulmes, Palatine, both of Ill.

[73] Assignee: American Can Company, Greenwich, Conn.

[21] Appl. No.: 234,451

[22] Filed: Feb. 13, 1981

[51] Int. Cl.[3] ..... B21B 45/00

[52] U.S. Cl. ..... 72/46; 72/349; 72/47

[58] Field of Search ..... 72/349, 46, 47, 42, 72/348

[56] References Cited

U.S. PATENT DOCUMENTS

| | | | |
|---|---|---|---|
| 3,655,349 | 4/1972 | Shah et al. | 72/42 |
| 3,934,527 | 1/1976 | Saunders | 72/47 |
| 3,945,231 | 3/1976 | Imazu et al. | 72/349 |
| 3,972,217 | 8/1976 | Misonoo | 72/349 X |
| 3,988,174 | 12/1976 | Saunders | 72/349 |
| 4,032,678 | 6/1977 | Perfetti | 72/46 |
| 4,040,282 | 8/1977 | Saunders | 72/349 |

*Primary Examiner*—Leon Gilden

*Attorney, Agent, or Firm*—Paul R. Audet; Aaron Passman; Stuart S. Bowie

[57] ABSTRACT

This disclosure relates to a product, the process for making same from precoated metal and the tool used for making the product. The product is a concurrently drawn and ironed sanitary food can wherein the side wall thickness of the container is relatively uniform and approximately 0.001" thinner than the thickness of the starting material. The process is a concurrent multiple drawing and ironing operation wherein the diameter and the wall thickness are reduced in each of a plurality of operations. Finally, the tools used for each drawing and ironing operation have particular configurations designed to permit this concurrent forming of both the diameter and the side wall thickness.

10 Claims, 7 Drawing Figures

PROCESS FOR MAKING CONTAINER

BACKGROUND OF THE DISCLOSURE

This disclosure relates to the way in which container bodies (the so-called two-piece bodies) are manufactured in drawing and ironing operations. For 20 years beverage containers have been made in a drawing and ironing process in which the material is first cupped to establish the inside diameter and then pushed through a series of ironing rings which merely thin the side wall and do not appreciably affect the diameter. The process is done at high speed under a coolant/lubricant flood in order to accommodate the severity of the operation especially the heat. These containers have to be washed and in some cases chemically treated to remove residual lubricant and improve corrosion performance of organic coatings and decoration subsequently applied to the container.

For the last 25 years, work has progressed on manufacturing drawn cans for food products. These containers were made of materials such as aluminum and low temper steels in order to facilitate the drawing operation. In addition to this the containers usually had a height about equal to or less than the diameter of the container and the containers were fashioned in a single or at most two drawing operations.

The need for a drawn container is the elimination of the side seam and one double seamed bottom in a traditional 3-piece container. More specifically, to make a 3-piece can a flat blank of material is rolled into a cylinder and seamed along one side by welding, cementing or soldering. To this hollow cylindrical body is added a double seamed bottom closure. The cylindrical body may be precoated and the side seam area may be repaired by a stripe. The operations of side seaming and double seaming are such that the quality of the container is dependent upon those seams. Of course, the cylindrical body has to be flanged in order to accept the factory applied bottom and the packer applied top end closures. The flanging and seaming operations require some care and can cause problems especially in the area of the side seam.

Only recently has it been possible to make multiple drawn two piece food containers which were fashioned from organically precoated tin free steel such that post-coating or post treatment operations were not necessary. More particularly, a 24 oz. 404×307 tin free steel container was made in a two draw operation. (The can makers convention gives the diameter across the completed doubleseam in inches plus sixteenths of an inch then the height in inches plus sixteenths of an inch. Therefore, the foregoing container is 4 4/16" in diameter by 3 7/16" in height). It has long been desired to be able to make a container whose height is appreciably greater than the diameter, using precoated starting material in a multiple draw process. It is also desired to make such a container in the popular 16 oz. 303×406 size or the 15 oz. 300×407 size or the 11 oz. 211×400 size.

The Assignee of the present disclosure has recently manufactured and sold drawn containers in the 16 oz. size and the 15 oz. size and have experimentally produced the 10 oz. size using precoated stock. A triple draw operation was required to make the foregoing containers, and that process tends to thicken the area of the container side wall near the open end.

The amount of thickening increases from the bottom of the container to the top and all the way to the tip of the flange. This thickening is a consequence of the drawing of the material from a flat disc-shape and the variable circumferential compression of the material as a function of its distance from the bottom of the ultimately formed cup. The additional material thickness at the top of the container serves no useful purpose, and is a waste of material, increasing the weight and cost of the container.

Previous technology used in connection with drawing containers included a punch and die combination wherein there was sufficient annular clearance between the outer surface of the punch and the inner surface of the die so that metal was not squeezed or thinned during forming. These clearances were on the order of one and one-quarter to two times the thickness of the material being drawn (for the types of steel and aluminum used to make cans). Additionally, the draw die radius (or surface over which the metal was drawn) had a radius of curvature of less than 0.125" to facilitate the movement of metal through the die. The use of such tooling reformed the metal and allowed the thickening of the upper side wall of the ultimately formed hollow container as already discussed.

In contradistinction, the drawing and ironing (D&I) process used for making beverage containers would have less clearance than the original metal thickness between the ironing ring and the punch. More specifically, the difference between that clearance and the thickness of the metal represented the amount to which the side wall of the container was thinned. Usually, metal with no organic coating passes through three different ironing rings in a D&I operation during which the T-1 temper ETP electrolytic tinplate is reduced about 25% in the first pass, about 25% of its new thickness in the second pass, and about 40% of its new thickness in the last pass, while the metal and tooling are flooded with lubricant coolant. This operation increases the side wall length to several times that of the cup which was formed in an ordinary and separate one or two-draw operation. The cross-sectional configuration of the ironing ring includes a chamfer, a land and finally a relief angle. The ironing process begins on the chamfer and is completed by the land at this time no drawing takes place. The D&I process has heretofore been one in which drawing and ironing takes place in a coolant-/lubricant flood. Coatings are normally applied after the shell has trimmed and washed free of lubricants. It was desired to concurrently draw and iron organically-precoated metal without having to remove the coolant-/lubricant and to find a way for making a container with a uniform wall thickness.

OBJECTS OF DISCLOSURE

It is, therefore, an object of the present disclosure to provide a material efficient container which has a relatively uniform side wall of a minimum thickness necessary to prevent panelling and crushing of the pack container.

It is a further object of the present invention to provide a process wherein a container can be made from precoated stock and have a uniform side wall by concurrently reducing the diameter and wall thickness in each of the multiple operations.

It is yet another object of this disclosure to have a tool which can be used to reduce both the diameter and the wall thickness in a single operation without the use of lubricants which must subsequently be removed.

It is still a further object of the disclosure to make the container economical, reliable and unique in its configuration and manufacturing techniques.

SUMMARY OF THE DISCLOSURE

The preferred container is fashioned from double reduced plate and more specifically from plate of DR8 or DR9 temper and about 65# per base box base weight. Here the preferred embodiment is made from tin free steel (TFS), tinplate, nickel plated steel, or steel base material. DR8 or DR9 is a tin mill product specification which relates to the process by which the metal is cold reduced in two stages with an anneal preformed between the two cold rolling operations. The steel is reduced approximately 89% in the first reduction, is annealled, and then is reduced about 25 to 40% in the second and final cold reduction. The base box terminology for base weight is standard in the can making industry; it originally referred to the amount of steel in a base box of tinplate consisting of 112 sheets of steel 14"×20", or 31,360 square inches plate. Today the base box as related to base weight refers to the amount of steel in 31,360 square inches of steel, whether in the form of coil or cut sheets.

This material may be coated on what ultimately will be the outside surface by an epoxy-resin-type or an organosol coating. The inside may be coated with a coating consisting of a combination of resins, which has been found to withstand the severe multiple-forming operation. Inside and outside coatings are capable of withstanding the drawing and ironing stresses typical of can making operations. Consequently, the container can be made from a relatively high temper material and may not require a postcoating.

The preferred method used in order to produce such a desired container uses a minimum amount of the high temper DR8 or DR9 steel, and it involves one to three concurrent drawing operations which may take place in a press such as that disclosed in U.S. Ser. No. 056,705 (SUPPORT PEDESTALS) which is assigned to the same Company as the present invention. For the case of a triple drawn and ironed can, in each forming operation, the diameter of the container and the wall thickness are concurrently reduced. More specifically, the first operation blanks and forms the sheet of precoated material into a shallow cup wherein the diameter is in excess of the height. During this operation the wall thickness is reduced by ironing while drawing such that the wall is finally brought down to approximately 0.001" less than the thickness of the bottom (the starting thickness of the precoated material). The second operation redraws the container and reduces the diameter and again concurrently irons the wall to maintain a reduced thickness from the top to the bottom. In this second operation the diameter is reduced and the height increased so that they are about equal. The final operation reduces the diameter still further and once again concurrently irons the side wall to produce a preferred thinness and uniformity such that the container achieves its final configuration. During this operation the bottom profile may be added to the container, see for example U.S. Ser. No. 120,399.

In the operations where the diameter is reduced and the side wall is thinned the ironing operation may be stopped before it reaches the flange in any of the multiple operations. Consequently, the flange thickness as well as the side wall area next adjacent the flange can be left thicker. In any event stopping the process defines where the side walls are ironed; the flange may be or may not be maintained.

In a fourth operation, the container flange is trimmed and the container is sent to a beading machine. It should be appreciated that a complete container can be manufactured without having the need for any washing, repair postcoating or additional energy-intensive operations.

The addition of ironing to the multiple-draw process permits the original cut edge or circular blank to have a smaller diameter than that necessary for an unironed similar size container. Therefore, the amount of steel used for this container is less than that needed for drawn containers of the same size. This reduction in steel saves material and reduces the ultimate container weight.

The tool or die used to provide concurrent drawing and ironing is a unique combination of the technology of tools for drawing and for ironing. That is to say that, the elements of the respective tooling and in particular, the die profile as viewed in a cross-section is adapted to concurrently draw and iron the container body side wall. The material thickening which occurs during the circumferential compression of the metal, being formed into a hollow cylindrical container, is ironed during drawing so that the thickness of the side wall can be less than the original material thickness.

The present disclosure shows a draw die having a draw die radius which curves inwardly toward the punch. The punch and die dimensions are chosen so that the metal must thin to pass through their annular clearance. Another modification to the draw die is a land which is placed below the draw die radius to assure that ironing takes place concurrently with the drawing operation. The metal being drawn is first bent over the draw die radius as the punch pulls the metal into the die. The metal is then pulled over the die radius and must unbend to become part of the straight side wall. It is very desirable that the undending at the termination of the die radius takes place prior to when the ironing begins. It is preferable that a transition taper or chamfer extend from the draw die radius to the ironing land. This transition can be axially short or long depending upon the operation that is to take place; this also helps to make the process less sensitive to alignment problems.

The ironing land is of sufficient length to thin the side wall without scuffing the precoating and to afford acceptable tool life. There is a relief angle in the die which gives longitudinal support to the land. The relief angle portion of the die is also necessary to accommodate circumferential stress induced by the ironed container as it passes therethrough. It has been found that with the proper selection of die radius, transition angle and length, land dimension and relief angle, precoated material can be concurrently drawn and ironed into cans with coating integrity sufficient to meet commercial requirements. Depending upon the ultimate configuration (height to diameter ratio) of the container, it passes through a plurality of tooling such as described in order to achieve the preferred configuration and the required ironing. This flexibility allows the process to be adapted to cover a wide commercial range of can sizes.

DETAILED DESCRIPTION OF THE DRAWINGS

Figure 1:
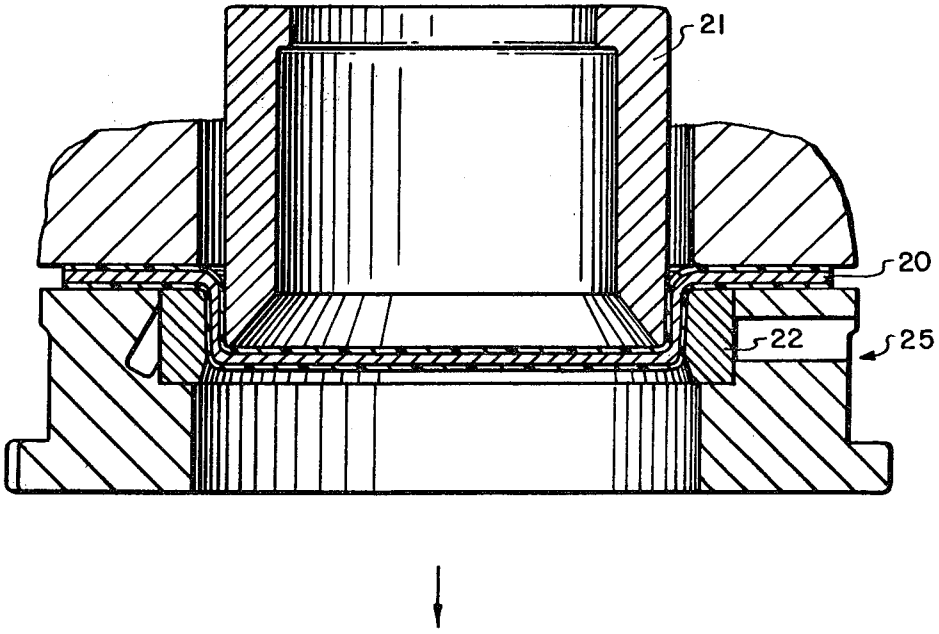
FIG. 1 is a partial side cross-sectional view showing the blank being formed into a shallow cup in the first step of the process of using a combined drawing and ironing tool for concurrent drawing and ironing.
Figure 1A:
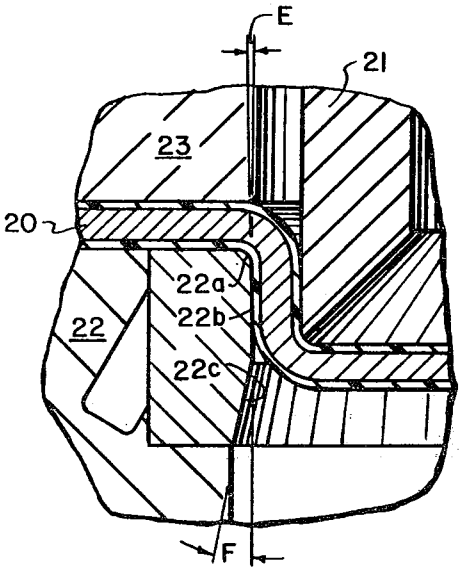
FIG. 1A is an enlarged partial sectional view of the tool area of FIG. 1.

In the Figures of this disclosure there is shown tooling used in the various steps of a multiple step process for making a container. In order to simplify the understanding of the Figures, the invention and the disclosure, the like parts of the tooling will be designated similarly. That is to say that, the precoated metal being formed into a container as shown in FIGS. 1 and 1A will be labelled 20, in FIGS. 2 and 2A as 30 and in FIGS. 3 and 3A as 40. Similarly, the tooling will be generally labelled 25 in FIG. 1; 35 in FIG. 2 and 45 in FIG. 3. The completed container is shown in FIG. 4 as 50. It should be appreciated that the reference numbers in the 20's are used in connection with FIGS. 1 and 1A; numbers in the 30'S are used in connection with FIGS. 2 and 2A and numbers in the 40's are used in connection with FIGS. 3 and 3A. Similar numbers will be used in connection with FIGS. 1 and 1A, 2 and 2A and 3 and 3A.

Turning now to FIG. 1, there is shown a punch 21 which is used for drawing a precoated sheet metal blank 20 into a cup shape through a draw die 22 and, in particular, across a draw die radius 22*a* (see FIG. 1A). Draw die radius 22*a* has a radius curvature in the range of 0.030" to 0.125". As also shown in FIG. 1A, there is an angle E for the taper which leads inwardly from the end of the draw die radius 22*a* to a straight die section or ironing land 22*b* which is the ironing part of the die 22. The land 22*b* is generally vertical or parallel to the axis of the punch 21. Consequently, the angle E, being the lead-in from the draw die radius 22*a* to the land 22*b*, represents a taper of about one-half to 3°. The land 22*b* is approximately in the range of 0.010" to 0.100" in vertical length and extends from its juncture with the taper from the draw die radius 22*a* to the beginning of a relief angle F or portion 22*c* of the die 22. This relief portion 22*c* angles outwardly from the vertical at about one-half to 15° and is included to accommodate circumferential and longitudinal stress in the die 22 due to the working forces encountered while ironing. More specifically, and as shown in FIGS. 1 and 1A, the blanked part has an original thickness as it is held under the draw clamp 23 of the tooling 25 before it is pulled into the clearance between the punch 21 and the die 22. This material thickness increases as it approaches the die radius 22*a* and is diminished slightly just after the material passes over the tangent point of the draw die radius 22*a*. It further thins slightly as it unbends as it comes off the die radius 22*a* and becomes part of the side wall. The material is thinned significantly as it is ironed in the clearance between the die 22 and the punch 21.

The side wall of the container or cup will be somewhat wedged shaped in section. For instance, thickness will increase with the height above the bottom. This is because the material thickness entering the ironing zone constantly increases due to circumferential compression. This greater thickness entering the ironing zone 22*b* causes greater load on the tooling 25 which is elastic and will deform. Further, since metal springback is a proportional phenomenon, increased incoming wall thickness produces an increased outgoing wall thickness.

Figure 2:
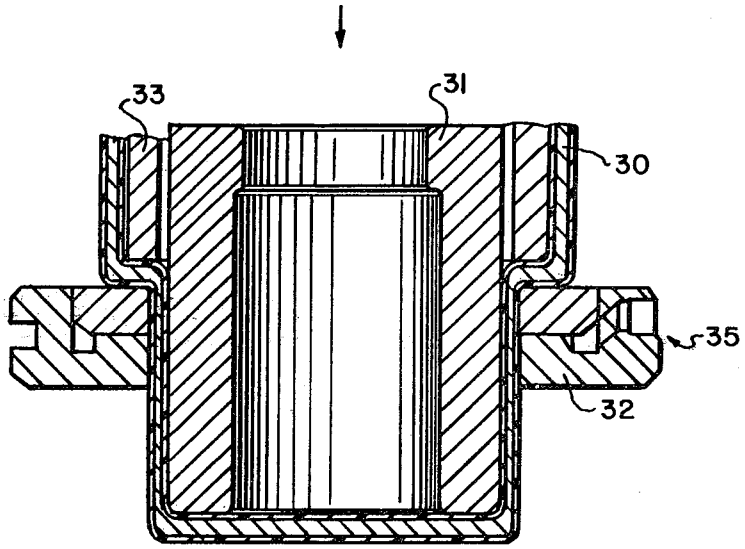
FIG. 2 is a partial side cross-sectional view showing the cup being further formed into a container whose height to diameter ratio is approximately one by means of another combined drawing and ironing tool designed to provide concurrent drawing and ironing in the second step of the process.
Figure 2A:
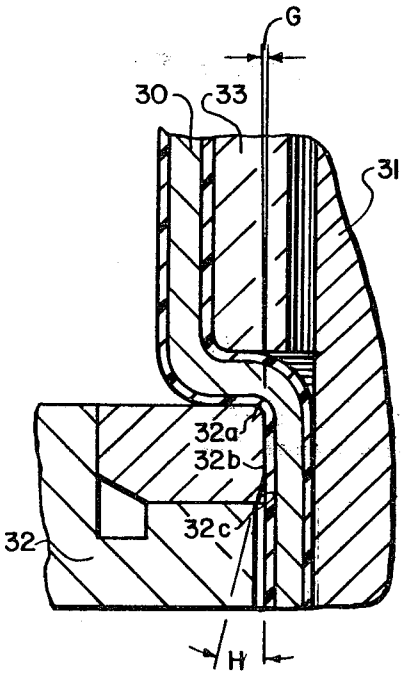
FIG. 2A is an enlarged partial sectional view of the tool area of FIG. 2.

Turning now to FIG. 2, there is shown a punch 31 which is used for drawing the cup formed by the tooling 25 of FIG. 1, into a taller and smaller diameter container. The tooling 35 of FIG. 2 is similar to that of FIG. 1. In FIG. 2A draw die radius 32*a*, has a radius curvature in the range of 0.030 to 0.125". As also shown in FIG. 2A, there is an angle G for the taper which leads inwardly from the end of the draw die radius 32*a* to a flat section or land 32*b* which is the ironing part of the die 32. The ironing land 32*b* is generally vertical or parallel to the axis of the punch 31. Consequently, the angle G, being the lead-in from the draw die radius 32*a* to the land 32*b*, represents a taper of about zero to 3°. The land is approximately in the range of 0.010 to 0.100" in vertical length and extends from its juncture with the taper from the draw die radius 32*a* to the beginning of a relief angle H or portion 32*c* of the die 32. This relief portion 32*c* angles outwardly from the vertical at about one-half to 10° and is included to accommodate circumferential and longitudinal stress in the die 32 due to the working forces encountered while ironing. More specifically and as shown in FIGS. 2 and 2A, the cup has an original thickness as it is held under the draw sleeve 33 of the tooling 35 before it is pulled into the clearance between the punch 31 and the die 32. This material thickness increases as it approaches the die radius 32*a* and is diminished slightly just after the material passes over the tangent point of the of the draw die radius 32*a*. It further thins slightly as it unbends as it comes off the die radius 32*a* and becomes part of the container side wall. The material is thinned significantly as it is ironed in the clearance between the die 32 and the punch 31.

The side wall of the redrawn container will be somewhat wedged shaped in section. For instance, thickness will increase with the height above the bottom. This is because the material thickness entering the ironing part 32*b* of the die 32 constantly increases due to circumferential compression. This greater thickness entering the ironing part 32*b* causes greater load on the tooling 35 which is elastic and will deform. Further, since metal springback is a proportional phenomenon increased incoming wall thickness produces an increased outgoing wall thickness.

Figure 3:
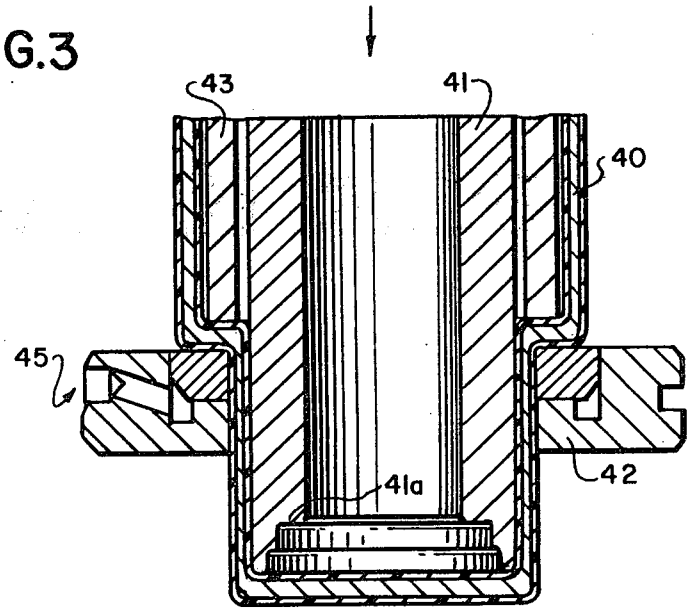
FIG. 3 is a partial side cross-sectional view showing the container being further formed into an elongated can wherein the side wall thickness is slightly less than the thickness of the original blank and by means of a combined drawing and ironing tool for concurrent drawing and ironing in the third step of the process.
Figure 3A:
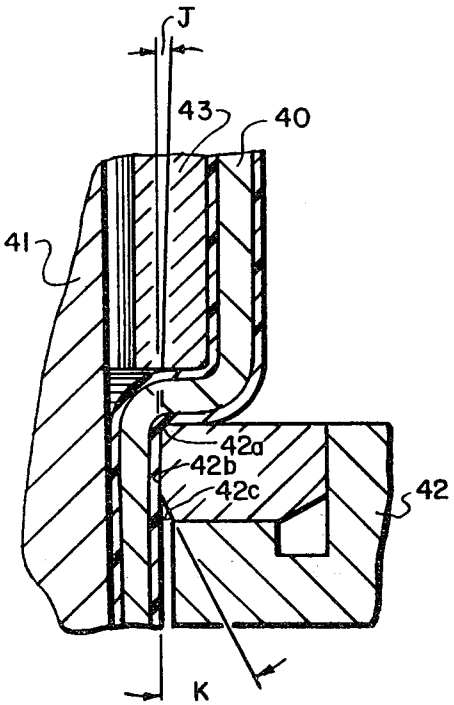
FIG. 3A is an enlarged partial sectional view of the tool area of FIG. 3.
Figure 4:
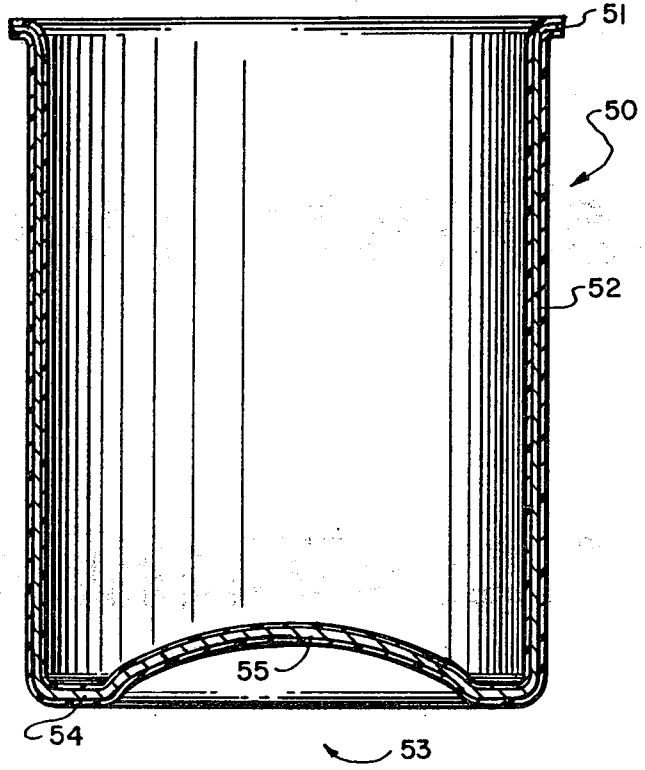
FIG. 4 is a side cross-sectional view of a container showing same after complete forming through the tools and by the processes of the present disclosure wherein the side walls are relatively uniform and slightly thinner than the unformed portions of the bottom of the container.

Turning now to FIG. 3, there is shown a punch 41 which is drawing the container 30 of FIG. 2 through a draw die 42, and in particular, across a draw die radius 42*a* (see FIG. 3A). Draw die radius 42*a*, has a radius curvature in the range of 0.030 to 0.125". As also shown in FIG. 3A, there is an angle J for the taper which leads inwardly from the end of the draw die radius 42*a* to a flat section or land 42*b* which is the ironing part of the die 42. The land 42*b* is generally vertical or parallel to the axis of the punch 41. Consequently, the angle J between the lead-in from the draw die radius 42*a* to the land 42*b* represents a taper of about zero to 3°. The ironing land 42*b* is approximately in the range of 0.010 to 0.100" in vertical length and extends from its juncture with the taper from the draw die radius 42*a* to the beginning of a relief angle K or portion 42*c* of the die 42. This relief portion 42*c* angles outwardly from the vertical at about one-half to 15° and is included to accommodate circumferential and longitudinal stress in the die 42 due to the working forces encountered while ironing. More specifically, and as shown in FIGS. 3 and 3A, the redrawn container has an original thickness as it is held under the draw sleeve 43 of the tooling 45 before it is pulled into the clearance between the punch 41 and the die 42. That material thickness increases as it approaches the die radius 42*a* and is diminished slightly just after the material passes over the tangent point of the draw die radius 42*a*. It further thins slightly as it unbends as it comes off the die radius 42*a* and becomes part of the container side wall. The material is thinned significantly as it is ironed in the clearance between the die 42 and the punch 41.

The side wall of the final container will not be measurably wedged shaped in section, because the multiple ironing operations have reduced nonuniformity due to drawing. While material thickness entering the ironing part of the die constantly increases due to circumferential compression, the effect is less since the percent diameter reduction is less. Consequently, the final or ultimate container will be largely uniform in sidewall thickness.

As shown in the Figures, the container material is metal with thin uniform precoatings on what ultimately becomes the inside and the outside surfaces. These coatings are designed to draw with the metal and not be torn or damaged such that the metal protective covering is lost even though ironing takes place in the process of drawing the material through and across the die.

FIG. 4 shows the completed container having a flange 51 and a side wall 52 and a bottom generally designated 53 with a downwardly facing circumferential flat 54 and a domed center section 55. The thickness of the material in the side wall 52 of the finished container 50 is relatively uniform. The thickest portion of the container is in the flat 54 which has the original thickness of the blank from which the container was made. The rest of the wall thicknesses have been thinned to approximately 0.001" less than the original thickness of the precoated blank. The thinning of the side wall 52 has been explained in connection with the multiple operations of drawing and concurrent ironing shown in the Figures and herein described. The thinning of the domed portion 55 of the container bottom takes place near the bottom of the stroke of the punch 41 in FIG. 3. It will be noted that the punch 41 has a recessed area 41*a* adapted to clear profile tooling (not shown) which contacts the bottom center section of the container 40 forming the domed bottom profile, in the bottom wall 53. In forming the dome 55, the material of the container bottom is stretched such that the wall thickness in the domed area has been diminished slightly.

The punch can be diametrically undercut or tapered to increase the ironed side wall thickness. If the punch is tapered the side wall near the bottom wall be thicker so that the ultimate container will have greater abuse resistance in this critical corner area.

The radius of the draw die is critical to the stress induced into the material as it is pulled by the punch from underneath the clamping load. More specifically, the draw die radius and the tapered lead to the ironing land must be adjusted to minimize the wrinkling which naturally occurs as the diameter of the undrawn material is reduced. As the material is pulled inwardly toward the radius of the draw die the radiating lines of residual stress are generated even though the material is held by a clamping load and the material is thickening. The nonuniform circumferential stresses produce a nonhomogenious condition of strain in the material evidenced by work hardening variability in the ultimately produced container side wall. That strain increases the probability of flange cracks parallel to the axis of the can. As explained herein, the material in the upper portion of the container can remain unironed and thus thicker. This extra thickness will help to resist cracking. However, in certain processes, it is envisioned that the entire container will be ironed and a flange subsequently formed. Thus, the importance of the draw die radius and the taper are greater since the need to minimize the formation strain is greater.

The taper between the draw die radius and the ironing land is critical from another standpoint apart from minimizing the strain induced into the material being drawn. That is to say that, the taper acts to pilot or guide the punch as it pushes the material into the ironing portion of the die. More specifically, tolerances on the position of the land, the concentricity of the punch and die and the various angles and radii in the cross-sectional configuration of the die profile all work to generate a certain amount of transverse motion between the punch and die. The taper being steep acts to center the movement of the punch relative to the die and causes the material to flow more uniformly through the annular clearance between the punch and the die. It can be appreciated that with multiple operations, the container wall uniformity from side to side will vary to some degree depending upon the clearances and tolerances prevailing in the proceeding operation. This nonuniformity presents a problem to the tooling of the next operation and a steep taper has been found to help overcome the problem and to minimize the pre-existing condition of the container such that it will function properly in the subsequent operation. Therefore, it has been found that the second and third operations of concurrent drawing ironing are possible with a taper of 0° under certain conditions.

The preferred embodiment a 303×406 container first formed into a cup by the punch 21 and the die 22 produce a shallow elongated cup from a circular blank having an approximate diameter of 7.947" and the resultant cup has an inside diameter of 5.007" and a height of approximately 2.000". The material thickness in the unironed bottom of the cup is 0.0076" and the average wall thickness of the side wall of the cup is approximately 0.0070". In FIG. 2, the cup 20 of FIG. 1 is redrawn into a taller and smaller diameter container wherein the height is about 3.350" and the inside diameter is about 3.805". Again, the material thickness in the bottom remains about 0.0076" and the side wall is on the average of 0.0067".

Finally, the container 30 of FIG. 2 is redrawn into the dimension of the finished item wherein the height is about 4.425" and the inside diameter is about 3.060". The thickness of the bottom material remains the same but the wall thickness is a relatively uniform average thickness of 0.0064".

Those skilled in the art of tooling and container making will no doubt appreciate that while a specific container has been shown and described this patent in its broadest context should be interpreted by the claims which follow. More particularly, the claims are intended to cover modifications and changes which would adapt the tooling to different size containers, different materials, different processes or any combination of the foregoing which would produce a container having a relatively uniform overall thickness with tooling that concurrently draws and irons to a degree sufficient to not only overcome the thickening of the wall but slightly reduce the wall thickness of the container.

What is claimed is:

1. A method of making a hollow cylindrical container open at one end and closed at the other from a thin sheet of metal including the following steps:

blanking a thin circular preform from metal precoated on the major surfaces thereof, said circle having a diameter about twice the ultimate diameter of the container and then immediately in a first operation concurrently drawing and ironing said preform into a shallow cup by drawing said preform to conform to the draw punch so that a diameter approximately twice its height is achieved and immediately thereafter ironing said drawn portion between said draw punch and an ironing portion of the draw die, and then concurrently redrawing and reironing said shallow cup in a second operation where said concurrent redrawing and ironing is performed apart from out of axial alignment with said first operation to reduce the diameter and side wall thickness of said cup during said second concurrent operation such that its height and diameter are about equal after redrawing said shallow cup to conform to the redraw punch and immediately ironing said redrawn portion between said redraw punch and an ironing portion of the redraw die and finally concurrently redrawing and reironing same in a third operation performed apart from out of axial alignment with said other operations to produce said ultimate diameter of said container being approximately 75% of its height and its side wall thickness slightly thinner than the thickness of said thin circular preform by again redrawing said redrawn cup to conform to said redraw punch and immediately ironing said redrawn portion between said redraw punch and an ironing portion of the redraw die.

2. The method of claim 1 wherein said steps include stopping said concurrent redrawing and reironing just short of said open end of said ultimate container to leave same with a heavier wall thickness about said open end.

3. The method of claim 1 wherein said steps include forming said shallow cup with an inside diameter of 5.007" and a height of 2.00".

4. The method of claim 3 wherein said steps include reforming said shallow cup to an inside diameter of 3.350".

5. The method of claim 4 wherein said steps include final forming said ultimate container to an inside diameter of 3.060" and a height of 4.425".

6. The method of claim 5 wherein said bottom wall of precoated metal blank is about 0.0076" thick and said side walls are about 0.0064" thick.

7. The method of claim 6 wherein forming is performed on material organically precoated on both sides without a flood of lubricant or coolant.

8. The method of claim 7 wherein forming is performed on electrolytic tinplate (ETP) without a flood of lubricant or coolant.

9. The method of claim 7 wherein forming is performed on tin-free steel (TFS) without a flood of lubricant or coolant.

10. The method of claim 7 wherein forming is performed on aluminum without a flood of lubricant or coolant.

* * * * *